US005671988A

United States Patent [19]

O'Neill

[11] Patent Number: 5,671,988

[45] Date of Patent: Sep. 30, 1997

[54] DRAWER SLIDE LATCH

[75] Inventor: Kevin O'Neill, Cambridge, Canada

[73] Assignee: Waterloo Furniture Components, Ltd., Kitchener, Canada

[21] Appl. No.: 449,808

[22] Filed: May 24, 1995

[51] Int. Cl.[6] ..... A47B 88/04

[52] U.S. Cl. ..... 312/334.44; 312/333

[58] Field of Search ..... 312/333, 334.44

[56] References Cited

U.S. PATENT DOCUMENTS

| | | | |
|---|---|---|---|
| 2,125,619 | 8/1938 | Parent | 312/333 |
| 4,005,507 | 2/1977 | Yamazaki | 24/150 R |
| 4,370,007 | 1/1983 | Fler | 312/333 |
| 4,482,066 | 11/1984 | Dykstra | 211/151 |
| 4,523,735 | 6/1985 | Beck et al. | 248/476 |
| 4,685,613 | 8/1987 | Schambre | 234/131 |
| 4,932,792 | 6/1990 | Baxter . | |
| 5,067,600 | 11/1991 | Koller | 192/56 R |
| 5,292,198 | 3/1994 | Rock et al. | 312/333 |
| 5,409,297 | 4/1995 | De Fillippo | 297/411.32 |

FOREIGN PATENT DOCUMENTS

| | | | |
|---|---|---|---|
| 2707365 | 8/1978 | Germany | 312/344.44 |
| 2081071 | 12/1982 | United Kingdom | 312/333 |
| 2019131 | 11/1992 | WIPO | 312/334.44 |

*Primary Examiner*—Peter R. Brown
*Assistant Examiner*—David E. Allred

[57] ABSTRACT

The present invention relates to a drawer slide assembly with an integral latch mechanism to inhibit inadvertent opening of a drawer. The structure of the present invention comprises an outer slide member and an inner slide member. The inner slide member is slidably engaged to the outer slide member. The structure includes an aperture in one of the slide members. A bearing is positioned to removably engage the aperture when the drawer slide assembly is in the closed position thereby forming a latch detent mechanism. The bearing is resiliently seated in a bearing retaining structure mounted on the drawer slide structure. The bearing retaining structure is provided with an element for providing a biasing force onto the bearing. This biasing force urges the bearing toward engagement with the aperture. When the bearing engages the aperture the inner slide member is held against slidable movement with respect to the outer slide member. This engagement provides for a secure latch to hold a drawer against inadvertent opening. The force necessary to disengage the latch is dependant upon the biasing force put upon the bearing.

7 Claims, 3 Drawing Sheets

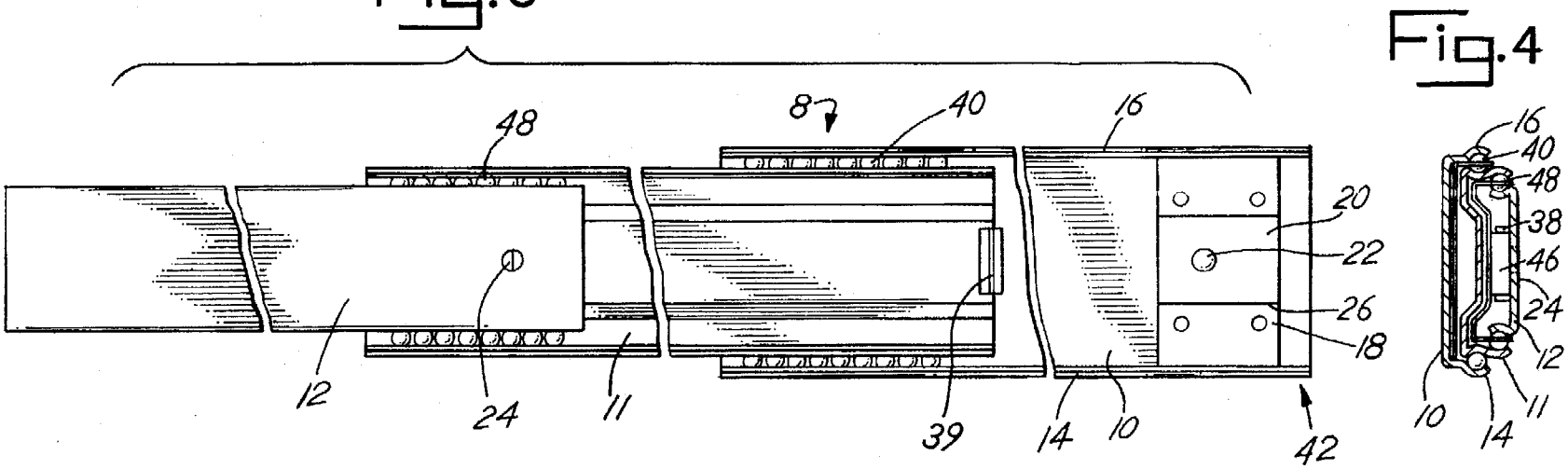
Fig. 4
Fig. 3
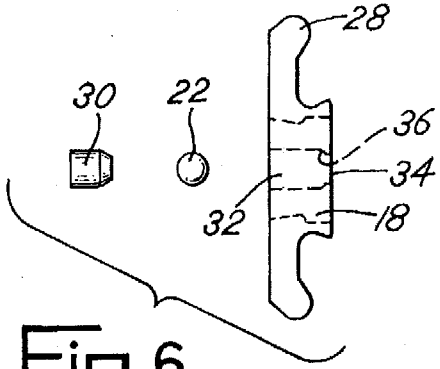
Fig. 6

DRAWER SLIDE LATCH

BACKGROUND OF THE INVENTION

1. Field of the Invention

The present invention relates to the field of drawer slides of the type used in file cabinets, desks and tool boxes. More precisely the present invention relates to drawer slides that are adapted to prevent the drawer from unintentionally opening.

2. Description of the Prior Art

Drawer slides are designed to function with a minimum amount of friction as a drawer is opened and closed. Such operation allows drawers that are filled with heavy materials to be opened and closed with minimal effort. Unfortunately, this has resulted in a situation where drawers sometimes open when they are not intended to open. This phenomenon is especially prevalent in file cabinet and tool boxes that are designed to be mobile. Specifically, as the cabinet is moved the drawers tend to open. Unintentional and unwanted opening can also occur if the drawer slide is not level.

The prior art utilizes several different mechanisms which inherently attempt to address this problem. One such mechanism includes a claw type latch device, constructed from plastic materials, devised to latch onto protrusions in the slide for the purpose of keeping the drawer closed. Another mechanism, designed to prevent drawer rebound, can also have the effect of latching the drawer closed. Such a device is shown in U.S. Pat. No. 4,932,792. A third mechanism utilizes a complex spring cam device designed to prevent drawer rebound, may also have some drawer latching qualities. Such a device is currently sold by Anchor Slide Company of the Netherlands. Each of these structures, however, has problems associated with them with respect to the desirability for using them to address the problem of unintentional drawer opening. These problems include—relatively low resistance to drawer opening, the structures require a large amount of space, the moving latches are subject to wear and breakage and the complex structure adds significantly to assembly and material cost.

There remains a need for a drawer slide that can reliably and economically keep a drawer from unintentionally opening.

SUMMARY OF THE INVENTION

The present invention relates to a drawer slide assembly with an integral latch mechanism to inhibit inadvertent opening of a drawer. The structure of the present invention comprises an outer slide member and an inner slide member. The inner slide member is slidably engaged to the outer slide member. The structure includes an aperture in one of the slide members. A ball bearing is positioned to removably engage the aperture when the drawer slide assembly is in the closed position. The ball bearing is resiliently seated in a ball bearing retaining structure mounted on the drawer slide structure. The ball bearing retaining structure is provided with means for providing a biasing force onto the ball bearing. This biasing force urges the ball bearing toward engagement with the aperture. When the ball bearing engages the aperture the inner slide member is held against slidable movement with respect to the outer slide member. This engagement provides for a secure latch to hold a drawer against inadvertent opening. The force necessary to disengage the latch is dependant upon the biasing force put upon the ball bearing.

The advantages of the present invention over the mechanisms of the prior art are many. Most importantly the present invention provides a simple and effective mechanism for the prevention of unintentional opening of drawers. Therefore, mobile file cabinets and tool boxes can be safely and rapidly moved without the inconvenience and danger of a drawer sliding open. While, at the same time, there is no need to latch and unlatch a cumbersome mechanism. The present invention provides an integral latch that engages when the drawer is closed.

It is a further advantage of the present invention to provide a latch that secures a drawer without the need to do anything but close the drawer. Therefore, there is no conscious effort necessary to secure the drawer.

It is an object of the present invention to provide a drawer slide assembly with an integral latch that will retain a drawer in the closed position against unintentional opening.

It is a further object of the present invention to provide a drawer slide assembly with an integral latch that can be disengaged simply by supplying reasonable force when pulling the drawer open. The requisite force is not excessive but it is more force than will be the result of either centrifugal force or jostling from the movement of a mobile file cabinet or tool chest.

It is yet a further object of the present invention to provide a drawer slide assembly with an integral latch mechanism that will prevent unintentional and undesired opening of drawers when a file cabinet is positioned on an uneven surface or the drawer slides are not mounted level.

It is still a further object of the present invention to provide a drawer slide assembly with an integral latch wherein said integral latch comprises a ball bearing that is biased to engage an aperture in the drawer slide construction and when the ball bearing engages the aperture the drawer associated with the drawer slide is secured against inadvertent opening.

It is still a further object of the present invention to provide a drawer slide assembly with an integral latch that can be effective in both two member and three member drawer slides.

These and other objects and advantages of the present invention will become evident from the following detailed description of the preferred embodiment.

BRIEF DESCRIPTION OF THE DRAWINGS

FIG. 3 is a side view of a three member drawer slide incorporating the present invention.

FIG. 4 is a cross section of the three member drawer slide incorporating the present invention.

FIG. 6 is an exploded cross section of the detent latch mechanism of the present invention.

DETAILED DESCRIPTION OF THE PREFERRED EMBODIMENT

The present invention relates to an improved drawer slide assembly of the type used in cabinets and tool boxes. These drawer slide assemblies are basically of two types: (1) a two part slide assembly, and (2) a three part slide assembly. The present invention is applicable to both types of assemblies.

Figure 1:
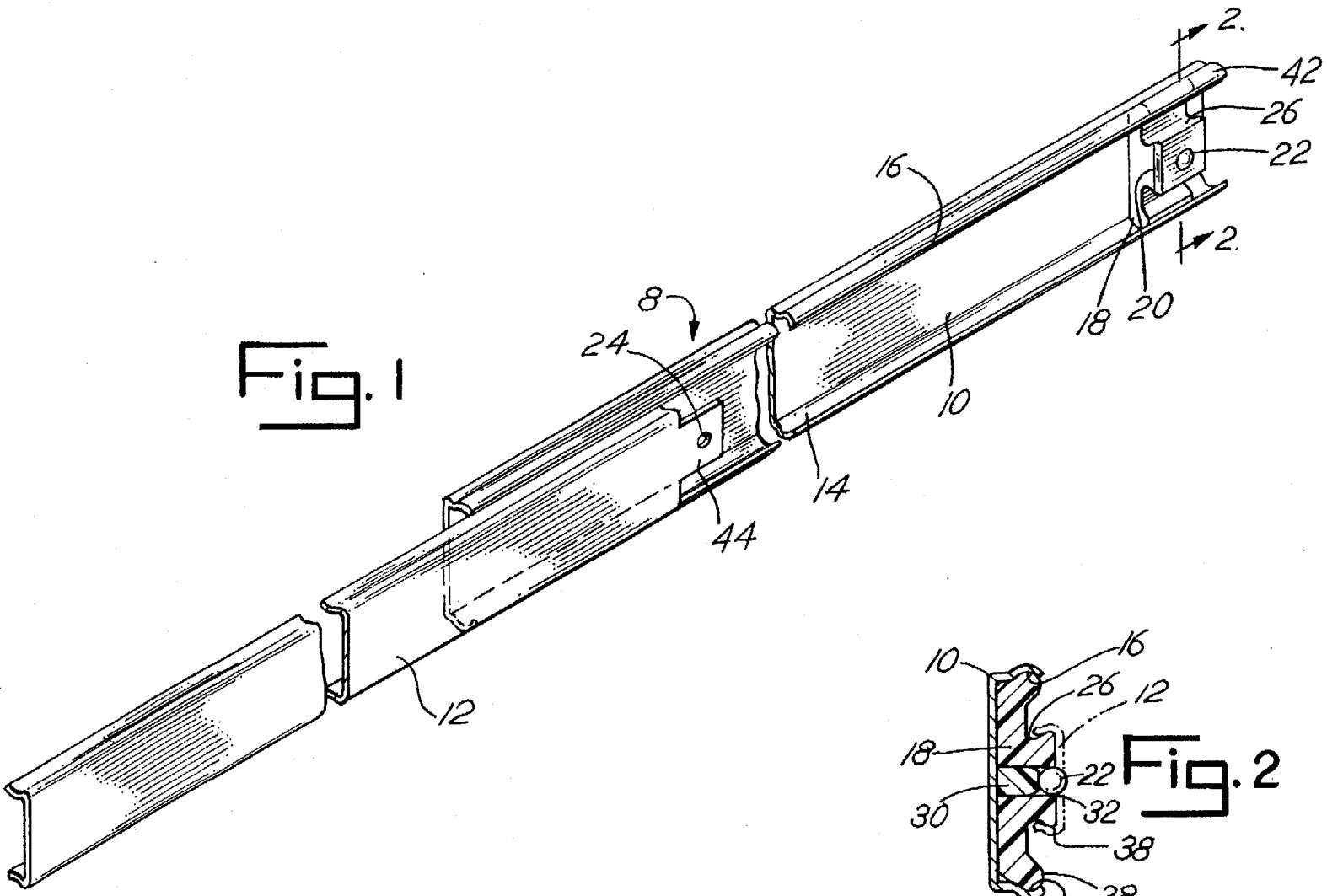
FIG. 1 is a perspective of a two member drawer slide incorporating the present invention.

A preferred embodiment of a two part slide assembly of the present invention is illustrated in FIG. 1. Referring to FIG. 1, a drawer slide assembly 8 comprises two slide members, an outer slide member 10 and an inner slide member 12. The inner slide member 12 is telescoped within the outer slide member 10 and is slidably engaged with the outer slide member 10. The outer slide member 10 includes a lower slot or channel 14 and an upper slot or channel 16. The channels 14, 16 are separated by a planar span 15 and are opposed to each other and define opposed parallel runways 13. Each of these channels 14, 16 support and engage a separate ball bearing race or retainer 40. The ball bearing race or retainer 40 is capable of moving in said runway 13. The inner slide member 12 includes parallel lateral edges which co-act with the ball bearings in the separate races 40 to permit the slide member 12 to freely slide with respect to the outer slide member 10. The ball bearing races or retainers 40 are generally of a shorter length than the inner slide member 12. Typically, the races 40 are positioned in the center portion of the inner slide member 12. The inner slide member 12 includes a tab 44 at one end extending beyond the travel of the ball bearing retainer 40. This tab 44 includes a pair of extending legs 38 projecting from the tab 44 toward the outer slide member 10 and defining a space 46 between them. The tab 44 also defines an aperture 24 into said space 46.

Referring further to FIG. 1 a ball bearing retaining structure 18 is mounted on the outer slide member 10. Preferably, the retaining structure 18 is mounted on the inner end 42 of the outer slide member 10. The structure 18 has a ball bearing 22 resiliently projecting from a passage or cavity 32 to form a latch detent mechanism. In the preferred embodiment of FIG. 1, the structure 18 also serves as a terminal bumper or stop member which acts to stop the slide motion of slide member 12 when the drawer is closed. The bumper or stop member structure 18 is preferably made of a rubber or elastomeric material giving it a resilient quality and sound deadening quality.

Figure 2:
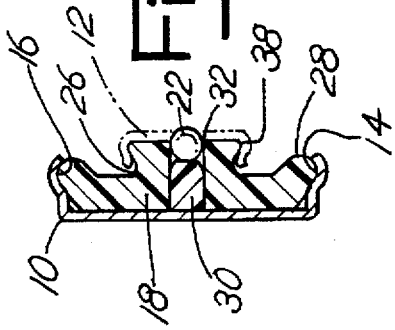
FIG. 2 is a cross-section of FIG. 1 along line 2—2.

A cross section of the bumper structure 18 of FIG. 1 is shown in greater detail in FIGS. 2 and 6. As clearly shown in FIGS. 2 and 6, bumper structure 18 includes a central passage or cavity 32 with a circular opening 34. The cavity 32 is sized to house the ball bearing 22 and a urethane plug 30. The ball bearing 22 extends partially through the opening 34 and is biased outwardly by the plug 30. The circular opening 34 has a diameter less than the diameter of cavity 32 and the ball bearing 22 so that less than half of the ball bearing 22 extends through the circular opening 34. The cavity 32 at the circular opening 34 also thus preferably includes arcuate circumferential rib or lip 36 shaped to retain the ball bearing 22 in cavity 32. The ball bearing 22 is provided with an outward bias by the urethane plug 30 located behind the ball bearing 22. Other mechanisms may be used to provide the biasing force and are well known in the art. For example a spring could replace the urethane plug 30. The urethane plug 30, however, has the advantage of providing precise control of the force applied upon the ball bearing 22. It is this biasing means that provides the ball bearing 22 with its resilient quality.

Preferably, structure 18 is also preferably shaped to operate within the drawer slide assembly. Specifically, in the preferred embodiments of FIGS. 1 and 2 the structure 18 includes at it outer ends a mating arm extension 28 sized to fit within the upper channel 16 and the lower channel 14. The structure 18 further includes a recessed channel midsection 20 which is shaped to receive the extending legs 38 of the tab 44 defined by the inner slide member 12. Specifically, the midsection 20 includes guideways 26 which receive the extending legs 38 of the inner slide member 12.

In another embodiment, the present invention is applicable to three member drawer slide assemblies as shown in FIGS. 3 and 4. In principal part the embodiment of FIGS. 3 and 4 are essentially the same as that shown in FIG. 1, with the exception that FIGS. 3 and 4 include an intermediate slide member 11 and an intermediate ball bearing retainer or race 48. The intermediate slide member 11 is telescoped within and slidably mounted on the outer slide member 10 and the inner slide member 12 is telescoped within and slidably mounted on the intermediate slide member 11. In the embodiment of FIG. 3 the ball bearing 22 engages the aperture 24 in a portion inner slide member 12 that extends beyond the end 39 of the intermediate slide member 11 when the slide assembly is in the closed position.

Figures 5, 7, 8:
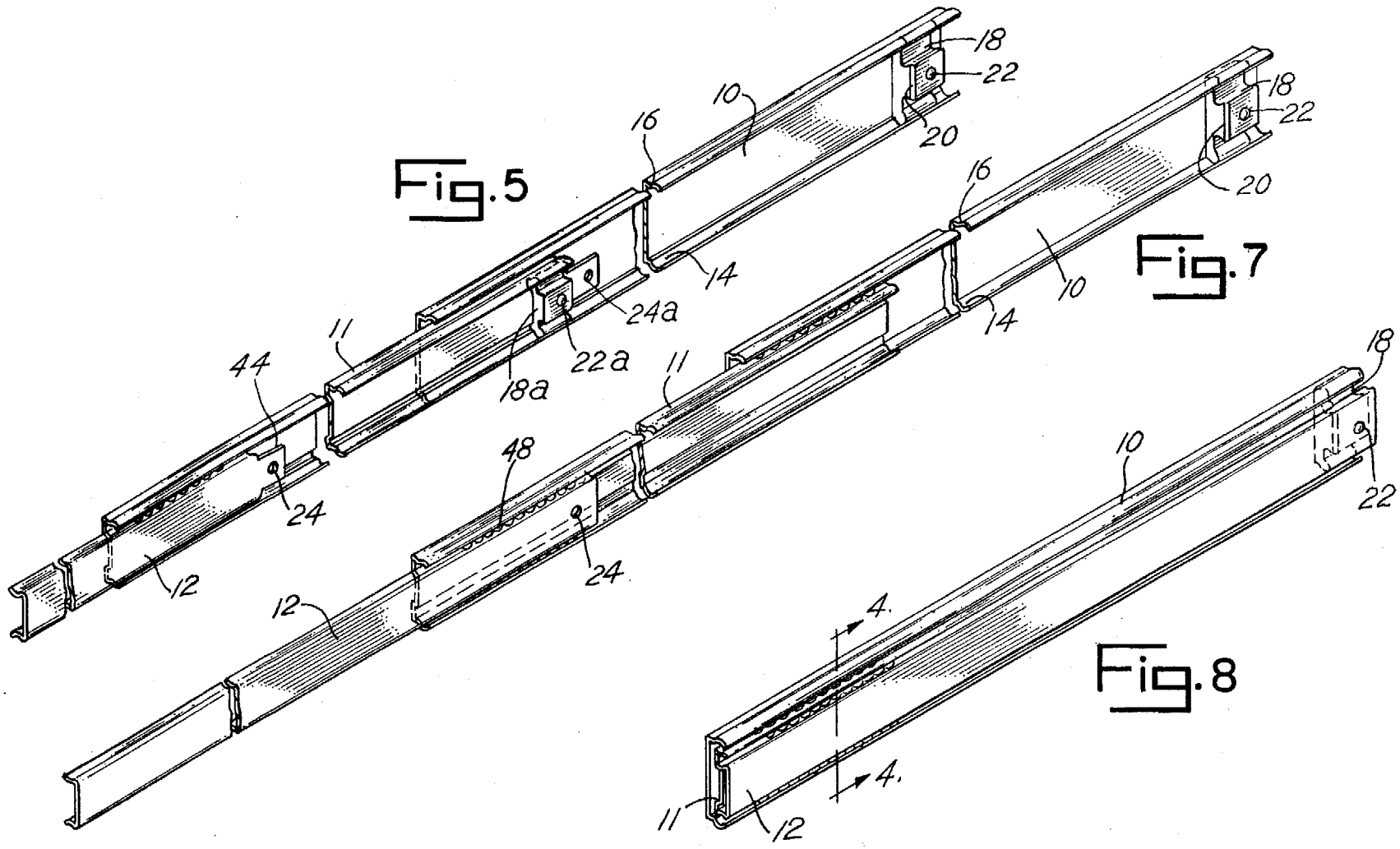
FIG. 5 is a perspective of a three member drawer slide illustrated a second embodiment of the present invention.
FIG. 7 illustrates a three member drawer slide incorporating the present invention in the open position.
FIG. 8 illustrates a three member drawer slide incorporating the present invention in the closed and latched position.

Alternative embodiments of the present invention are possible. One example is shown in FIG. 5 wherein the drawer slide structure includes two ball bearing retaining structures 18 and **18*a* located on the outer slide member 10 and the intermediate slide member 11 respectively. In such a construction the ball bearing 22 of the structure 18 engages an aperture 24*a* on the intermediate slide member 11 and the ball bearing 22*a* of the structure 18*a* engages the aperture 24 on the inner slide member 12**.

It is further noted that in a preferred embodiment the structure 18 is located at the end of the slide members 10 and 11. This location, however, is not necessary. The ball bearings 22 and **22*a* could be located at a position intermediate the ends of the slide members 10, 11** as long as the slidable movement is not hindered. The end location, however, is especially preferred because it is believed to be the location that will cause the least noise and the least resistance when the drawer is opened and closed.

It will be appreciated by one skilled in the art that substitutions can be made in the preferred embodiments discussed above. For example, the ball bearing retainer or race 40 can be replaced with rollers in an appropriate drawer slide assembly. Likewise, the position of the aperture 24 and ball bearing 22 can be reversed, i.e., mounting the ball bearing 22 on the inner slide member 12. Such modifications of the preferred embodiment are well within the skill of one skilled in art and within the spirit and scope of the present invention.

In operation the present invention acts to latch a drawer in the closed position. Such operation is illustrated in FIGS. 7 and 8. FIG. 7 shows a three member drawer slide assembly expanded in the open position. FIG. 8 illustrates a three member drawer slide assembly in the closed and latched position. When the drawer is closed the ball bearing 22 engages the aperture 24. This engagement keeps the drawer closed. The drawer is opened simply by pulling the drawer with sufficient force to overcome the biasing force put upon the ball bearing 22 by the plug 30, thereby compressing the plug 30 and causing the ball bearing 22 to disengage the aperture 24.

The preferred embodiment of the present invention is now fully described. The above description, however, is only illustrative of the invention and is not intended to limit the invention in spirit or scope. Only the following claims and their equivalents limit the scope of the invention.

I claim:

1. A drawer slide comprising, in combination:

at least first and second telescoping slide members for slidable attachment of a drawer to a cabinet, said slide members each having opposed channels extending in a telescoping direction between opposite ends, said opposed channels being separated by a planar span, the channels of the second member slidably received in the space separating the channels of the first slide member, and a detent latch for releasably maintaining the slide members in a fixed telescoping condition, said detent latch comprising:

an elastomeric stop member structure mounted in the first slide member at a fixed position, said stop member structure dimensioned to fit within the spaced, opposed channels of the first slide member against the planar span and having a mid section between the spaced, opposed channels of the first slide members, said stop member structure further including a passage in the mid section, a bearing projecting from the passage away from the planar span of the first slide member, said passage including biasing means for biasing the bearing away from the planar span;

said stop member structure defining a stop for limiting telescopic movement of the second slide within the first slide; and said second slide including an integral tab projecting from one of said opposite ends between the spaced channels thereof cooperative with the bearing to engage the bearing and retain the tab and second slide in a detent releasable position when the tab is positioned over the stop member structure.

2. The drawer slide of claim 1 wherein the tab includes an aperture for receipt of the bearing.

3. The drawer slide of claim 1 wherein the tab comprises an extension of the planar span of the second slide member.

4. The drawer slide of claim 1 wherein the tab includes at least one leg cooperative with the midsection for guiding the second slide member.

5. The drawer slide of claim 1 wherein the tab includes opposed legs cooperative with the midsection.

6. The drawer slide of claim 1 wherein the stop member structure is retained by the channels and planar span of the first slide member and defines a stop for the second slide member and a detent latch member.

7. The drawer slide of claim 1 further including a third slide member, said second slide member including a second stop member structure, and said third slide member including a tab for detent cooperation with the second stop member.

* * * * *